United States Patent [19]

Almour

[11] Patent Number: 4,764,762

[45] Date of Patent: Aug. 16, 1988

[54] EARTHQUAKE ALARM ASSEMBLY

[76] Inventor: Ralph Almour, 6936 Huntington La., #404, Delray Beach, Fla. 33446

[21] Appl. No.: 902,642

[22] Filed: Sep. 2, 1986

[51] Int. Cl.[4] ..... G08B 21/00

[52] U.S. Cl. ..... 340/690; 340/566; 340/540; 200/61.45 R; 200/61.48; 200/52 R; 181/122; 367/182

[58] Field of Search ..... 340/566, 690, 65, 540, 340/683; 367/179, 182, 183, 184, 188, 189; 200/61.45 R, 61.49, 61.48, 61.52, 61.83; 181/122

[56] References Cited

U.S. PATENT DOCUMENTS

| | | | |
|---|---|---|---|
| 3,649,787 | 3/1972 | Kasabian | 340/566 X |
| 3,678,763 | 7/1972 | Brooks et al. | 200/61.45 M |
| 4,221,940 | 9/1980 | Roth | 200/61.45 R |
| 4,262,289 | 4/1981 | Rivera | 340/690 |
| 4,297,690 | 10/1981 | Baker | 340/690 |
| 4,381,504 | 4/1983 | Bitko | 340/566 X |

FOREIGN PATENT DOCUMENTS

| | | | |
|---|---|---|---|
| 0161378 | 11/1985 | European Pat. Off. | 340/690 |
| 2730518 | 1/1979 | Fed. Rep. of Germany | 340/690 |

*Primary Examiner*—Joseph A. Orsino
*Assistant Examiner*—Tat K. Wong
*Attorney, Agent, or Firm*—John Cyril Malloy

[57] ABSTRACT

An alarm assembly specifically designed to warn sleeping occupants within a dwelling structure as to the occurrence of earth tremors such as those caused by relatively serious earthquakes wherein an activating member is movably positioned relative to a supporting base and is sensitive to such earth tremors to the extent of being displaced within a predetermined range of movement and into activating engagement with a switching assembly also mounted on said base to cause operation and/or activation of preferably an audio alarm to awaken the sleeping occupants.

5 Claims, 1 Drawing Sheet

EARTHQUAKE ALARM ASSEMBLY

BACKGROUND OF THE INVENTION

1. Field of the Invention

This invention relates to an earthquake alarm assembly capable of being self-contained by including a DC battery source and a circuit means which allows the activation and closing of at least one of a plurality of switches causing current feed to an audible indicator structure when displacement of an activating member occurs due to earth tremors effecting the stability of a building structure.

2. Description of the Prior Art

In certain geographical locations in the world natural phenomenon known as earthquakes are quite common. When such naturally inclined earthquake areas are also the location of large population sites, property damage and loss of life and injury are a factor to be reckoned with in everyday life.

While earth tremors associated with earthquakes are obviously self-evident during most of the day, as when people are awake, at work, etc. there is a particular danger of the aforementioned damage being done during the evening hours when most of the members of a population are asleep.

Accordingly, there is a need in the alarm industry for an alarm device specifically designed to warn sleeping occupants in a dwelling structure and like location that earth tremors have begun. Typically, major earthquakes begin with somewhat minor earth tremor disturbances which are not readily detected by those who are sleeping. However, it is also generally acknowledged that early detection and warning of an oncoming earthquake and the more serious earth tremors associated therewith is necessary to avoid bodily harm to the extent of remaining within the open areas of buildings without taking necessary precautions. The existence and automatic activation and operation of an earthquake alarm would be desirable therefore from the standpoint of awaking sleeping occupants of a building even during the onset of minor earth tremors. In such a preferred embodiment an audible indicator or signal could be activated of sufficient intensity to wake up people throughout a single family dwelling structure or the larger structures such as in hotels, dormitories, etc.

The prior art has attempted numerous structures, indicators, alarms, etc. in an effort to provide a selection of devices which solve the above set forth problem. Such devices are disclosed in the following U.S. patents which include: U.S. Pat. Nos. 4,028,659; 4,028,567; 4,107,545; 4,361,740 and 4,470,040. Particularly, in the last indicated patent, the structure disclosed therein relates to a microvibration detector using a single peizoelectric element as both sensor and alarm generator. In the device disclosed therein and being representative of prior art devices, a sound emitter receives a vibration and in turn generates an electromotive force that causes activation of an alarm. However, in the specification of this patent, the inventor indicates that his invention operates by contact. When a person steps on a thin plate causing the alarm to generate. While alarms of this type are generally well known they are not adaptable for an earthquake alarm.

SUMMARY OF THE INVENTION

The present invention is related to primarily a residential earthquake alarm of the type designed to emit an audible indicating signal of sufficient intensity to wake sleeping occupants. While the subject alarm assembly is specifically adaptable for use as a home or residential alarm, it can also be adapted for use in multi-occupant or multi-family buildings such as apartments, condominiums, hotels, dormitories, etc.

The subject alarm assembly includes a base structured to be affixed to a building structure, preferably about the ceiling thereof so as to generally depend therefrom. The base includes certain circuit means, to be explained in greater detail hereinafter, but which preferably includes a self-contained electrical power source such as a DC battery supply arranged in series to activate an audible indicator structure such as a buzzer, siren, whistle, horn, etc. Activation of the buzzer through the establishment of current flow thereto from the battery source is accomplished by the closing of one of a plurality of switches defining a switch assembly.

More specifically, an activating member is secured to depending, substantially suspended relation from the base in preferably but not necessarily a downwardly hanging vertical orientation therefrom. The aforementioned switch assembly comprises a plurality of switches or switch components disposed in spaced relation to one another and to the activating member. The activating member is cooperatively structured with the switch assembly and the individual switches so as to be at least partially conductive. Alternately, the activating member is structured to engage a cooperating throw arm. Accordingly, when the activating member comes in contact with one of the switches of the switch assembly or cooperating throw arm, the circuitry is closed and current flow exists between the DC battery source and the indicator element therefore sounding an alarm which awakes sleeping occupants.

Support and connection of the indicator member is accomplished by a support structure which preferably is in the form of a flexible, resilient material spring assembly or like element. The spring assembly and material from which it is formed has sufficient structural integrity to maintain the activating member in movable disposition within a predetermined field of movement. The dimensions and range of movement of the activating member is directly dependent upon the structure, dimension and configuration of the spring assembly causing the depending suspension of the activating member from the base portion which itself is attached to the ceiling of the building structure. Any tremor felt or absorbed by the building structure will cause a vibration. Such vibration in turn causes relative movement or displacement of the activating member throughout the predetermined range of movement and into interruptive engagement with at least one of the switches of the switch assembly. This contact will serve to move the contact switch into a circuit closed position thereby enabling current flow from the aforementioned battery or like power supply to the indicator element setting off the audible alarm and allowing occupants of the building to be properly warned. Such warning will occur even when such tremors are relatively mild such as during the onset of a major earthquake or at the beginning of additional tremors of greater intensity. The occupants then properly take cover or flee the building structure in order to avoid harmful bodily damage to themselves or loved ones.

The invention accordingly comprises the features of construction, combination of elements and arrangement of parts which will be exemplified in the construction hereinafter set forth and the scope of the invention will be indicated in the claims.

BRIEF DESCRIPTION OF THE DRAWINGS

For a full understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
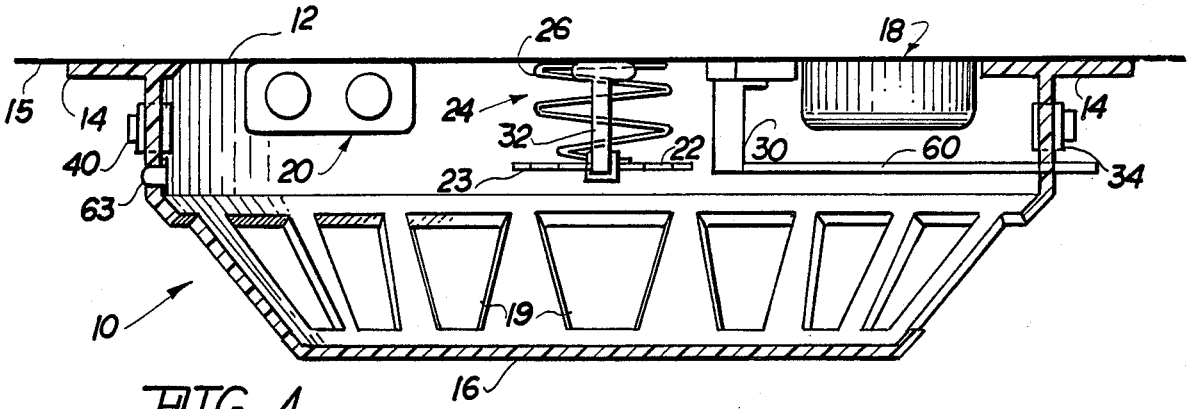
FIG. 1 is a detailed sectional view of the operative components of the subject earthquake alarm assembly and their relative operative position to one another.
Figure 2:
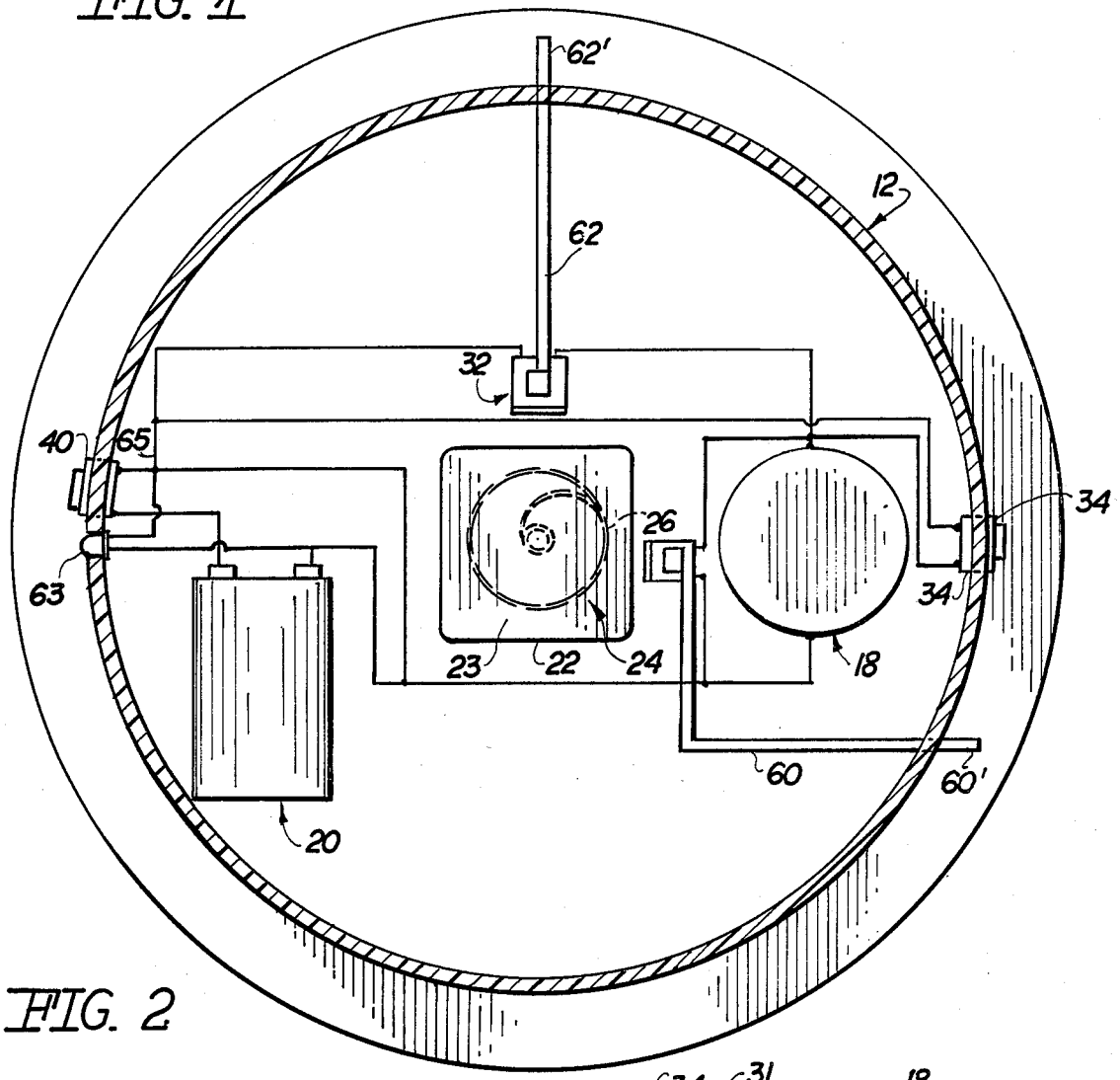
FIG. 2 is a schematic representation of the various components and their electrical interconnections.

As shown in FIGS. 1 and 2, the present invention relates to an alarm assembly generally indicated as 10 including a base portion 12 specifically structured to be affixed to a wall surface, preferably a ceiling surface of a building structure such as by peripheral flange or outwardly extending flanged portions as at 14. Connection to be ceiling structure may occur with any of a number of conventional means as long as a fixed relation between the base 12 and the ceiling surface or structure 15 is established. Accordingly, any tremors or vibrations absorbed or encountered by the building structure will of course be "felt" alarm assembly 10 due to such fixed connection.

A surrounding housing 16 may include an apertured construction as at 19 wherein such apertures establish communication between the exterior and interior of the casing 16 and effectively allow an audible signal or loud sound to be heard or generated from the interior of the casing 16 as from an audible indicator structure such as a buzzer generally indicated as 18.

The alarm assembly 10 of the present invention further includes preferably a self-contained electrical power supply generally indicated as 20 in the form of a DC battery pack of the like. The existence and incorporation of such an independent power supply eliminates the need for the alarm assembly 10 to rely on the conventional AC power supply associated with the building structure. Accordingly, in cases of power outage or extensive damage to the building structure, the alarm will still be operable regardless of the existence of current flow to the building.

An important feature of the present invention is the provision of an activating member 22 secured to the base 12 in substantially depending and outwardly extending and suspended relation from the base 12. Interconnection between the activating member 22 and the base 12 occurs by a support structure generally indicated as 24 preferably in the form of a spring 26. The spring may take a variety of structural configurations but is preferably formed of a flexible, resilient material construction construction such that the activating member 22 is freely suspended and is allowed to move within a predetermined range of movement, to be explained in greater detail hereinafter, similar to a pendulum swing.

The aforementioned predetermined range of movement is specifically determined by the structural and dimensional characteristics of the spring assembly 26. The activating member 22 in the form of a contact plate 23 is allowed to swing in almost any direction as it maintains its suspended movable connection to the base 12. The predetermined range of movement may be preselected and may of course be varied by varying the structural dimensional and configurational characteristics of the spring assembly 26. The term "predetermined range of movement" has no specific dimensional parameters other than the dimensional extent or range over which the activating member or contact plate 23 is displaced when the entire building 15 and base 12 encounter vibration caused by earth tremors or other forces. Such vibration, due to the flexible, resilient characteristics of the spring assembly 26 will be transferred directly to the activating member 22 or contact plate 23 to the extent of causing its displacement from its normally vertically suspended and probably still position. When such displacement and movement occur, the contact plate 23, being at least partially formed of conductive material will come into contact with a switch assembly.

The switch assembly comprises a plurality of switches such as those indicated as 30 and 32 disposed in spaced apart relation to one another and to the activating member 22 or contact plate 23. However, it is important to note that the plurality of switches 30 and 32 are maintained within the aforementioned predetermined range of movement. Accordingly, when there is no vibration the contact plate 23 remains in a somewhat stable non-moving position in spaced relation and out of engagement with the plurality of switches 30 or 32. However, the absorption of vibration caused by any type of earth tremors to the building 15 will be transferred to the base 12 and in turn will cause a pendulum-like movement or swing of the contact plate 23 due to its flexible, resilient interconnection to the base 12 by means of the spring assembly 26. This movement, if sufficient, will cause interruptive engagement between the contact plate 23 and at least one of the switches 30 and 32. Such interruptive engagement will complete the circuit causing the individual switches 30 and/or 32 which are engaged, to assume a normally circuit closed position from their normally circuit open position.

The normally circuit closed position referred to above will close the circuit completing current flow from the electrical power source or batteries 20 to the indicator element or structure 18 causing the audible signal to emanate from the housing 16 through the plurality of apertures 18. It is specifically provided that the intensity of the audible signal given off will be sufficient to awake sleeping occupants within the range of hearing of such alarm assembly 10.

Figure 3:
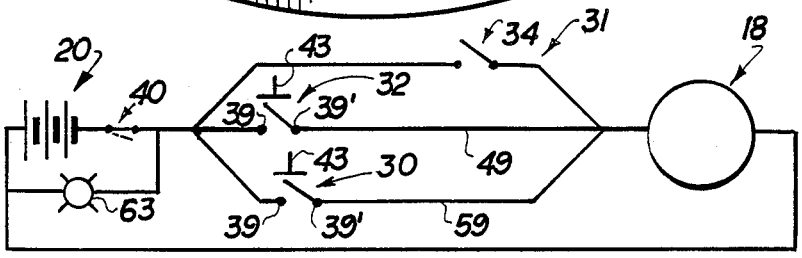
FIG. 3 is a schematic representation of a circuit diagram representing certain components of the subject alarm assembly as well as their relative position to one another to establish proper current flow during the onset of even mild earth tremors in a building structure in which the subject assembly is mounted.

Other features associated with the subject alarm assembly include an on/off activating switch 40 and a test switch 34. With regard to the schematic representation as shown in FIG. 3, it is seen that the switch assembly generally indicated as 31 comprises a plurality of switches 30 and 32 normally in their open position. Similarly, the switch assembly 31 may include the aforementioned test switch 34 also normally in its open position.

The power supply or battery pack 20 is shown in the aforementioned circuit in series with the on/off activating switch 40 both of which are in series connection with the indicator structure 18 in the form of a buzzer or like audible generating signal.

As the circuit is represented in FIG. 3, each of the switches 30, 32 and 34 are disposed in parallel relation to one another. The circuit is maintained in an open condition thereby allowing no current to flow from the power supply 20 to the indicator structure or buzzer 18. Obviously, a closing of any one of the switches 30, 32 and 34 will close the circuit, completing current flow to the buzzer and cause an activation of the emanation of the audible signal from the housing 16. In a test condition with the on/off activating switch normally closed, the test switch 34 may be manually closed or manipulated into a circuit closed position in order to test the system making sure that the power supply 20 is operative and similarly that the buzzer 18 is in operating order. When the test switch 34 is moved back to its open position, manually, the circuit is ready for activation in the normally intended fashion.

In actual operation during the existence of any moderate earth tremor, the contact plate will either directly engage the open contacts 39 and 39' of each of the switches 30 and 32 thereby completing the circuit and allowing current flow due to the fact that at least a portion of the contact plate 23 may itself be conducted. Alternately, some type of throw switch member 43 may be associated with each of the switches 30 and 32 which, when directly engaged by the contact plate 23 and/or the activating member 22 is forced into a circuit closed position thereby allowing current flow through either one of the parallel branches 49 or 59. The circuit is complete and the buzzer is activated and the audible signal is generated to cause an awakening of the sleeping occupants.

Another structural feature of the present invention is the provision of an operating light 63 activated by positioning the on/off switch 40 to the on position (see FIG. 3). This provides a clear indication to the user that battery 20 is charged and operating properly.

With regard to the structure of FIG. 2, a reset means in the form of mechanical or electrically activated plungers 60 and 62 are provided to cause disengagement of the throw arm 43 from the respective contacts 39 and 39' or alternately to disengage the contact plate 23 from such closed contact position with the aforementioned contacts 39 and 39' in order to totally reset the alarm assembly and open the switches into the circuit open position as shown in FIG. 3. The opposite end of the reset arms 60 and 62 may protrude outwardly as at 60' and 62' (see FIG. 2) to render these reset arms accessible from the exterior of the casing.

It is therefore to be understood that the following claims are intended to cover all of the generic and specific features of the invention herein described, and all statements of the scope of the invention which as a matter of language, might be said to fall therebetween.

Now that the invention has been described,

What is claimed is:

1. An earthquake alarm assembly primarily designed for the warning of occupants in a building of earth tremors, said assembly comprising:

(a) a housing including a base portion structured for fixed mounting in depending relation on a horizontal support surface within the building.

(b) an activating member movably secured to and in spaced relation below said base portion and a support device comprising a coil spring with a vertical axis attached to said base portion and to said activating member in interconnecting relation therebetween, (c) said activating member comprising a conductive material member, (d) said coil spring being structured and configured to permit a predetermined range of movement of said activating member, (e) said activating member and support device cooperatively dimensioned and configured for displacement of said activating member throughout a predetermined range of movement relative to said base, (f) an indicator structure mounted on said base portion and a circuit means associated therewith mounted on said base portion and comprising a switch assembly and a power source electrically interconnected to one another for selectively activating said indicator structure, (g) said switch assembly structured for maintenance in a normally circuit open position and disposed in spaced relation to said actuating member and within said predetermined range of movement and in interruptive position relative to said activating member when said activating member is displaced relative to said base portion within said predetermined range of movement, (h) said activating member comprising structure to define a switch closing member and displaceable within said predetermined range of movement into engagement with said switch assembly means, said switch assembly means being disposed and structured to assume a circuit closed position when engaged by said activating member, said circuit closed position defining current flow from said power supply to said indicator structure causing activation thereof, (i) whereby earth tremors caused by an earthquake cause a bouncing and jiggling randomized movement of displacement of said activating member throughout said predetermined range of movement and into activating engagement with said switch assembly means, and (j) said switch assembly means including a first and a second switch, each of said switches being disposed in spaced relation to said activating member and within said predetermined range of movement, each of said switches being structured to independently assume a circuit closed position and being operable to activate said indicator structure upon engagement with said activating member, (k) said activating member and said switches having operating portions normally in substantial coplanar relation with one another and said switches being angularly displaced with respect to one another.

2. An assembly as in claim 1 wherein said circuit means comprises said power supply connected in series with said indicator structure and said plurality of switches each connected in parallel relative to one another between said power source and said indicator element.

3. An assembly as in claim 2 wherein said switch assembly further comprises a test switch structured for manual activation and orientation in a circuit closing position, said test switch connected in parallel relation to said plurality of switches and in series connection between said power source and said indicator structure.

4. An assembly as in claim 1 wherein said power supply comprises a DC battery source removably mounted and stored on said base portion, whereby said alarm assembly is self-contained.

5. An assembly as in claim 1 further comprising reset means secured to said base portion and selectively disposed in operable engagement with said switching assembly for disconnection of said activating member with said switching assembly, whereby said earthquake alarm assembly is reactivated.

* * * * *